US007000501B1

(12) United States Patent
Chen

(10) Patent No.: US 7,000,501 B1
(45) Date of Patent: Feb. 21, 2006

(54) BIT FOR REMOVING DAMAGED SCREWS

(76) Inventor: Po-Shen Chen, No. 33-33, Lane 320, Sec. 1, Shatian Rd., Dadu Township, Taichung County (TW)

( * ) Notice: Subject to any disclaimer, the term of this patent is extended or adjusted under 35 U.S.C. 154(b) by 0 days.

(21) Appl. No.: 10/952,946

(22) Filed: Sep. 29, 2004

(51) Int. Cl.
*B25B 13/50* (2006.01)

(52) U.S. Cl. ..... 81/53.2; 7/158

(58) Field of Classification Search ..... 81/53.2, 81/441, 121.1, 120, 124.3; 7/158
See application file for complete search history.

(56) References Cited

U.S. PATENT DOCUMENTS 1,863,046 A * 6/1932 Githens et al. ..... 81/441
5,251,516 A * 10/1993 Desaulniers ..... 81/53.2
6,511,267 B1 * 1/2003 Slaughter ..... 408/1 R
6,742,416 B1 * 6/2004 Bergamo ..... 81/53.2
2003/0136228 A1 * 7/2003 Liu ..... 81/53.2
2003/0188604 A1 * 10/2003 Bergamo ..... 81/53.2
2004/0000218 A1 * 1/2004 Bergamo ..... 81/53.2
2004/0007095 A1 * 1/2004 Meng ..... 81/53.2
2004/0237725 A1 * 12/2004 Kozak ..... 81/53.2
2004/0250657 A1 * 12/2004 Chu ..... 81/53.2
2005/0183548 A1 * 8/2005 Horobec ..... 81/53.2

* cited by examiner

*Primary Examiner*—David B. Thomas
*Assistant Examiner*—Robert Scruggs
(74) *Attorney, Agent, or Firm*—Charles E. Baxley

(57) ABSTRACT

The present invention relates to a bit for removing damaged screws, the bit of the present invention is able to reach and engage the deep portion of the slot of the damaged screws, while the conventional bit is unable to do so, so as to remove the damaged screw. The bit is designed to have a sharp tip which can engage the deep portion of the slot of the damaged screw, so as to get a good purchase and leverage on the damaged screw to remove it easily.

3 Claims, 9 Drawing Sheets

BIT FOR REMOVING DAMAGED SCREWS

BACKGROUND OF THE INVENTION

1. Field of the Invention

The present invention relates to a bit, and more particularly to a bit for removing damaged screws.

2. Description of the Prior Arts

Screws may be damaged due to many reasons, for example, the rotating force applied on the screws by the user is not smooth, the contacting angle between the screwdriver and the screw is incorrect, the tip head of the screwdriver is broken, and etc. All these factors can cause the damage of the screw, and the damaged screws cannot be screwed again, and the working efficiency for screwing the screws is inevitably decreased. U.S. Pat. No. 6,595,730 discloses a bit for removing damaged screws, as shown in FIGS. 1 and 2, the bit 10 has an hexagonal end which is to be held in a chuck of an electric tool, and another tip end of the bit 10 is formed with two recesses 11. The recesses each are defined by a planar scraping surface 12, 13 having a scraping edge 121, 131. An upward rounded surface 14 is defined between the scraping edges 121, 131. As shown in FIG. 3, the scraping edges 121, 131 of the bit 10 engage the slot or cross recess 21 of the damaged screw 20 and have a purchase and leverage on the head of the damaged screw 20 to break it away from its firm engagement with the object (not shown) and put it into rotation with the bit and back it out. However, in real operation, there is a need for improving this conventional bit, and the reasons are explained as follows:

First, the upward rounded surface 14 defined between the scraping edges 121, 131 is round-shaped, in other words, is in the shape of sector. The more closer to the outer edge of the upward rounded surface 14, the larger the distance between the scraping edges 121, 131 will be. In this case, the depth the bit 10 engaged in the slot or recess 21 of the damaged screw 20 is limited by the upward rounded surface 14, thus weakening the engaging force of the scraping edge 121, 131 acted on the damaged screw 20, and as a result, the leverage on the damaged screw 20 is less effective.

Second, the slot 21 of the screw 20 may be completely damaged and turned into a downward rounded surface, in this case, the conventional bit 10 is stopped by the upward rounded surface 14 and is unable to remove the damaged screw 20. In other cases, only the superficial portion of the slot 21 is damaged and the deep of the slot 21 is still in the shape of a slot (for example, the slot is a cross slot), at this moment, the bit 10 is also unable to engage the damaged slot 21, and as a result the screw 20 cannot be removed.

Third, the upward rounded surface 14 defined between the scraping edges 121, 131 is round-shaped, to remove the screw 20, the slot 21 of the screw 20 is likely to be damaged by the bit 10, to a great extent. Therefore, this conventional bit 10 is unable to remove such a screw 20 with a straight slot 21.

The present invention has arisen to mitigate and/or obviate the afore-described disadvantages.

SUMMARY OF THE INVENTION

The primary objective of the present invention is to provide a bit for removing damaged screws which is able to engage the slot of the damaged screw more deeply, so as to get a good purchase and leverage on the damaged screw to remove it easily.

The secondary objective of the present invention is to provide a bit for removing damaged screws which is also adapted to remove the screw with a straight slot, thus improving the applicability.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
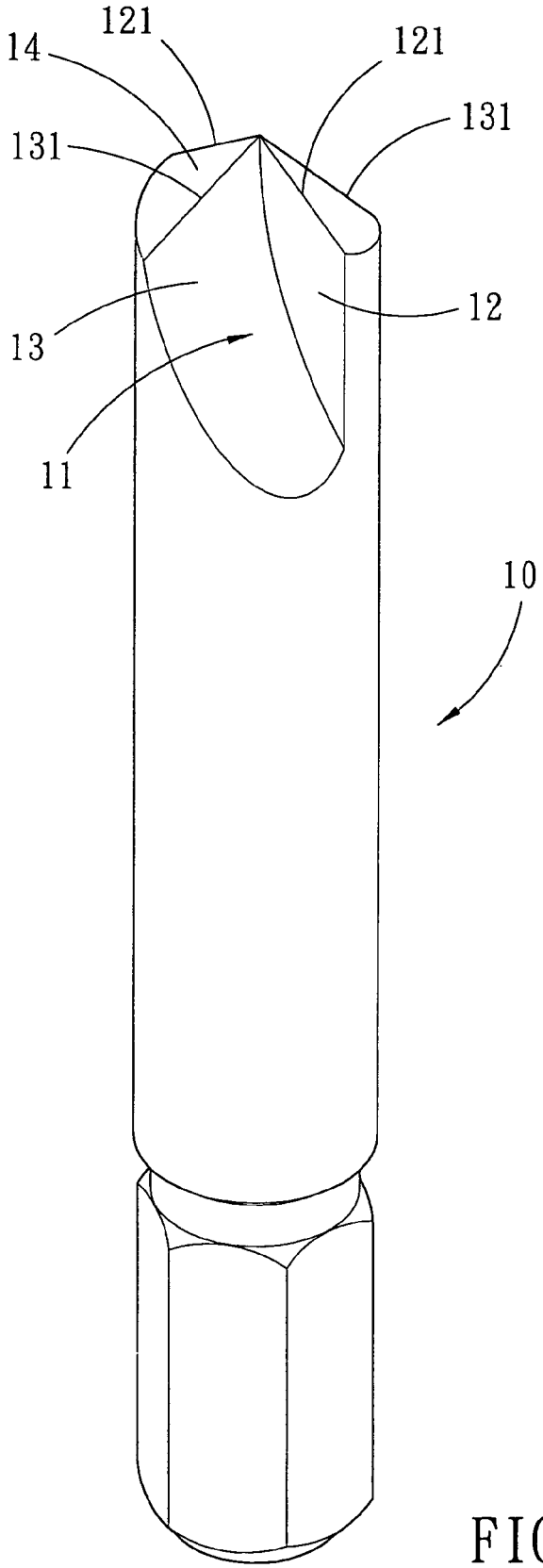
FIG. 1 is a perspective view of a conventional bit.
Figure 2:
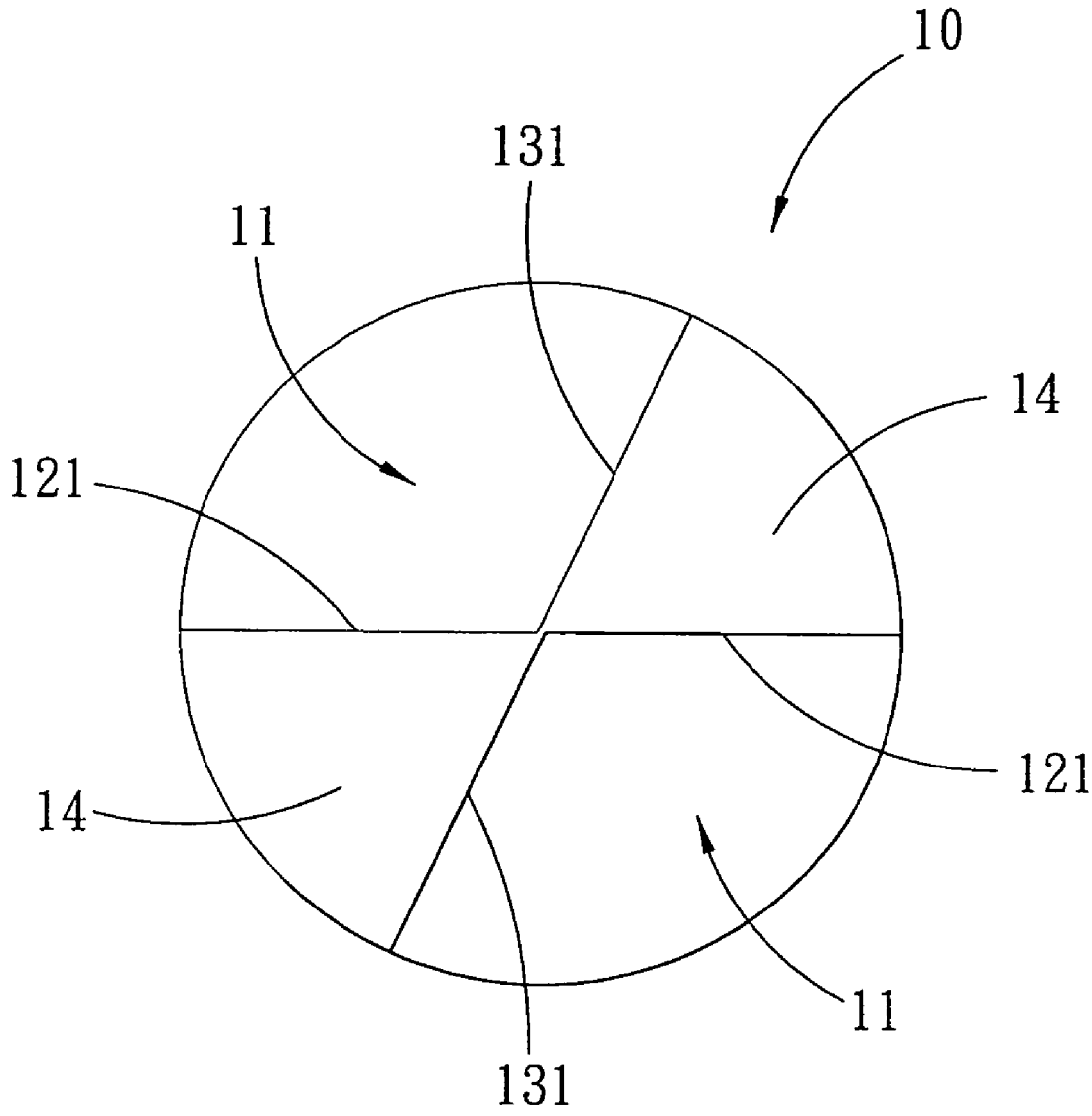
FIG. 2 is top view of a conventional bit.
Figure 3:
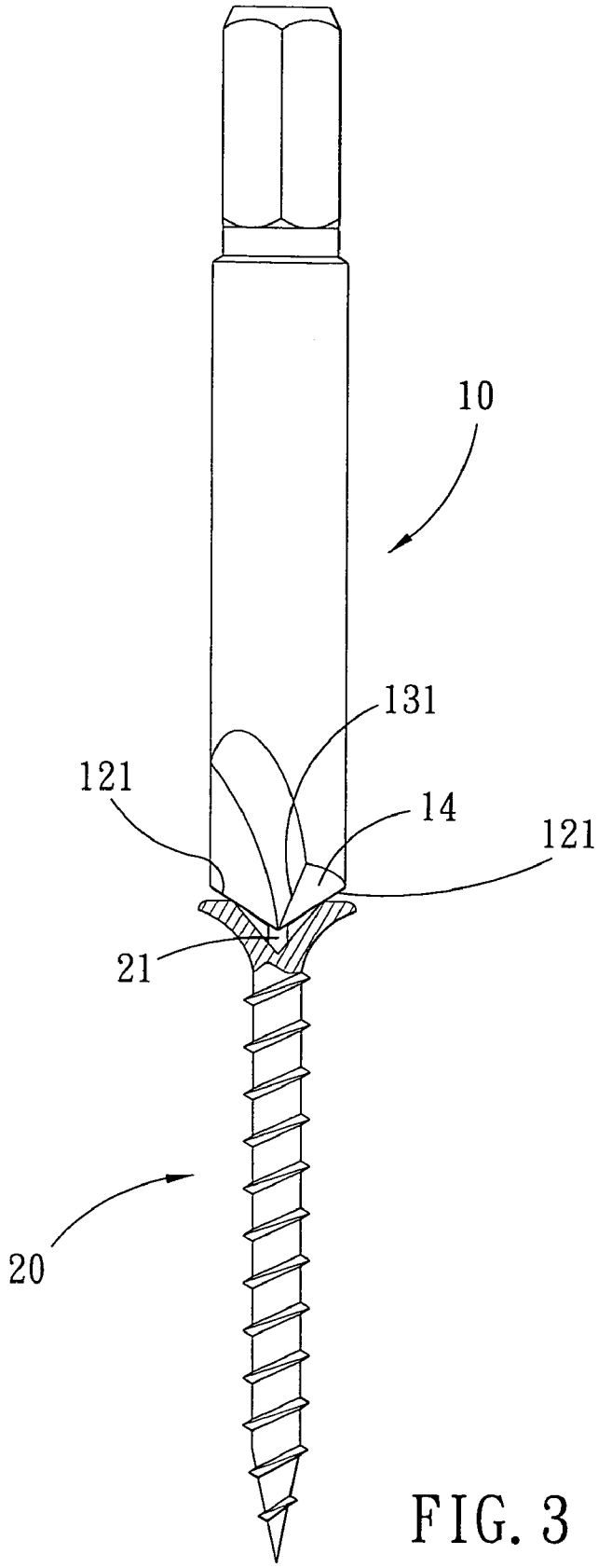
FIG. 3 is an operational view of a conventional bit.
Figure 4:
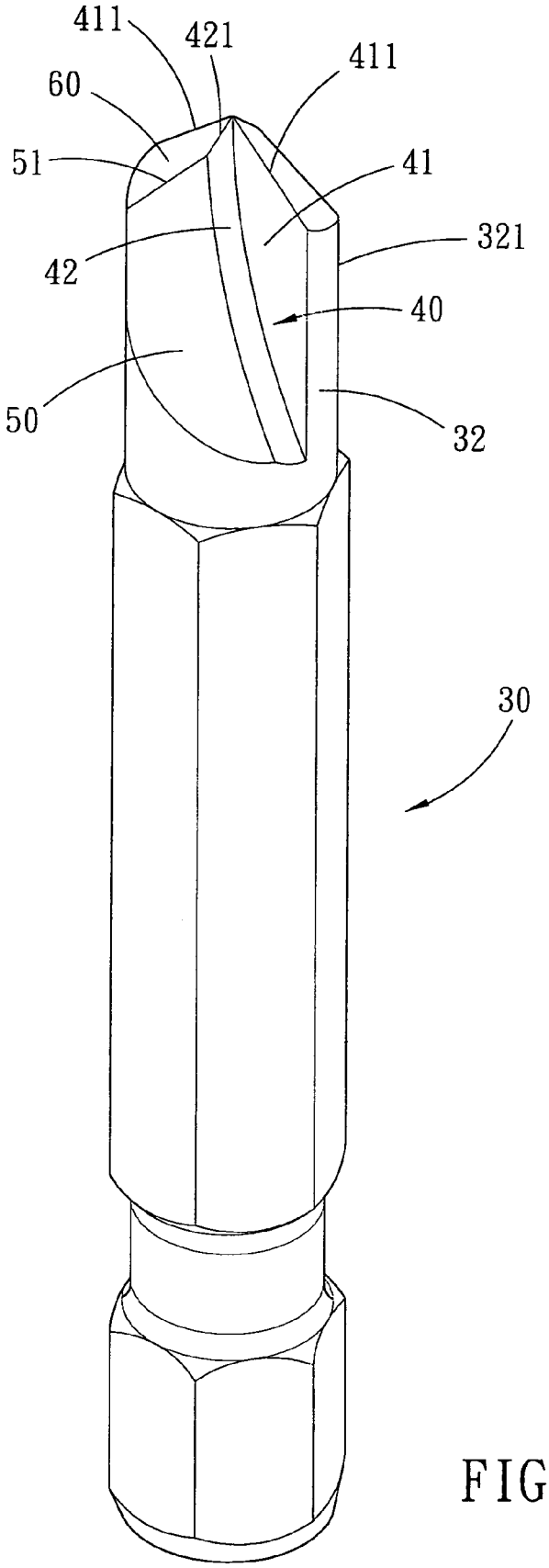
FIG. 4 is a perspective view of a bit in accordance with the present invention.
Figure 5:
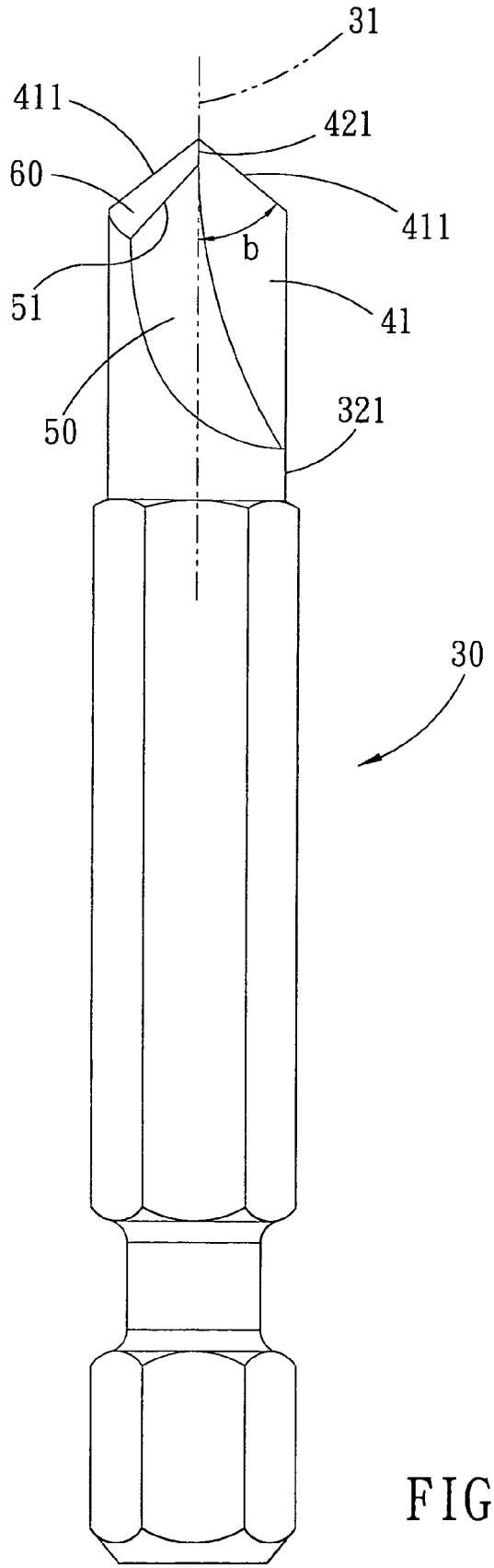
FIG. 5 is a side view of a bit in accordance with the present invention.
Figure 6:
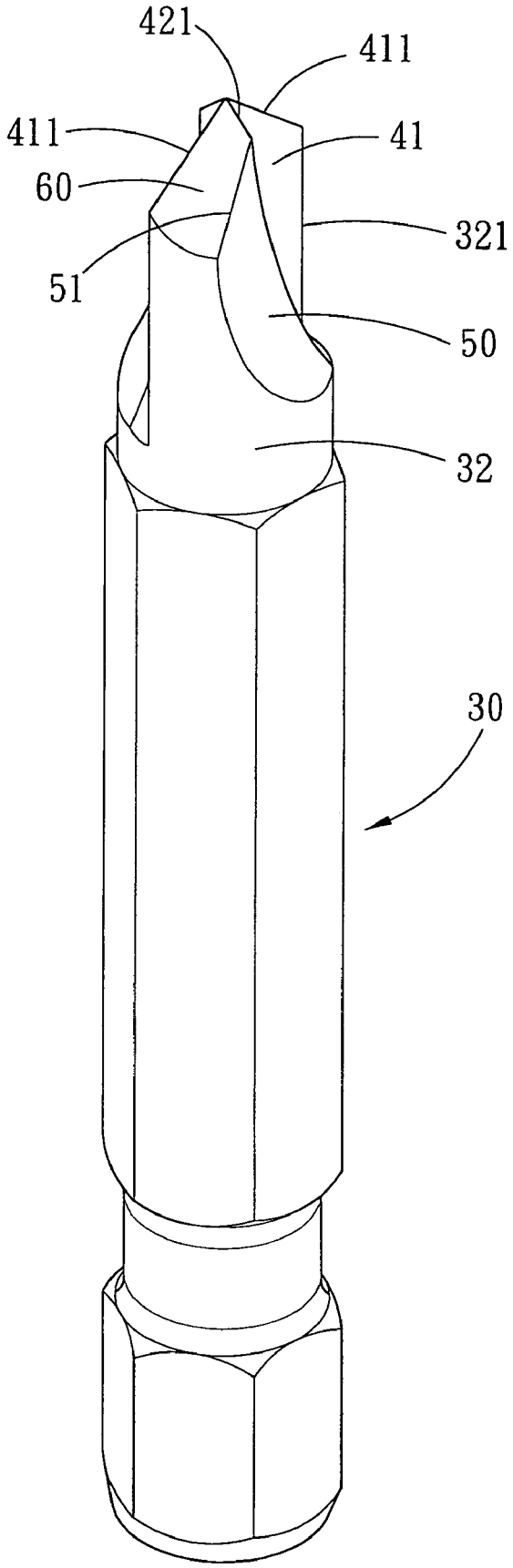
FIG. 6 is another perspective view of a bit in accordance with the present invention.
Figure 7:
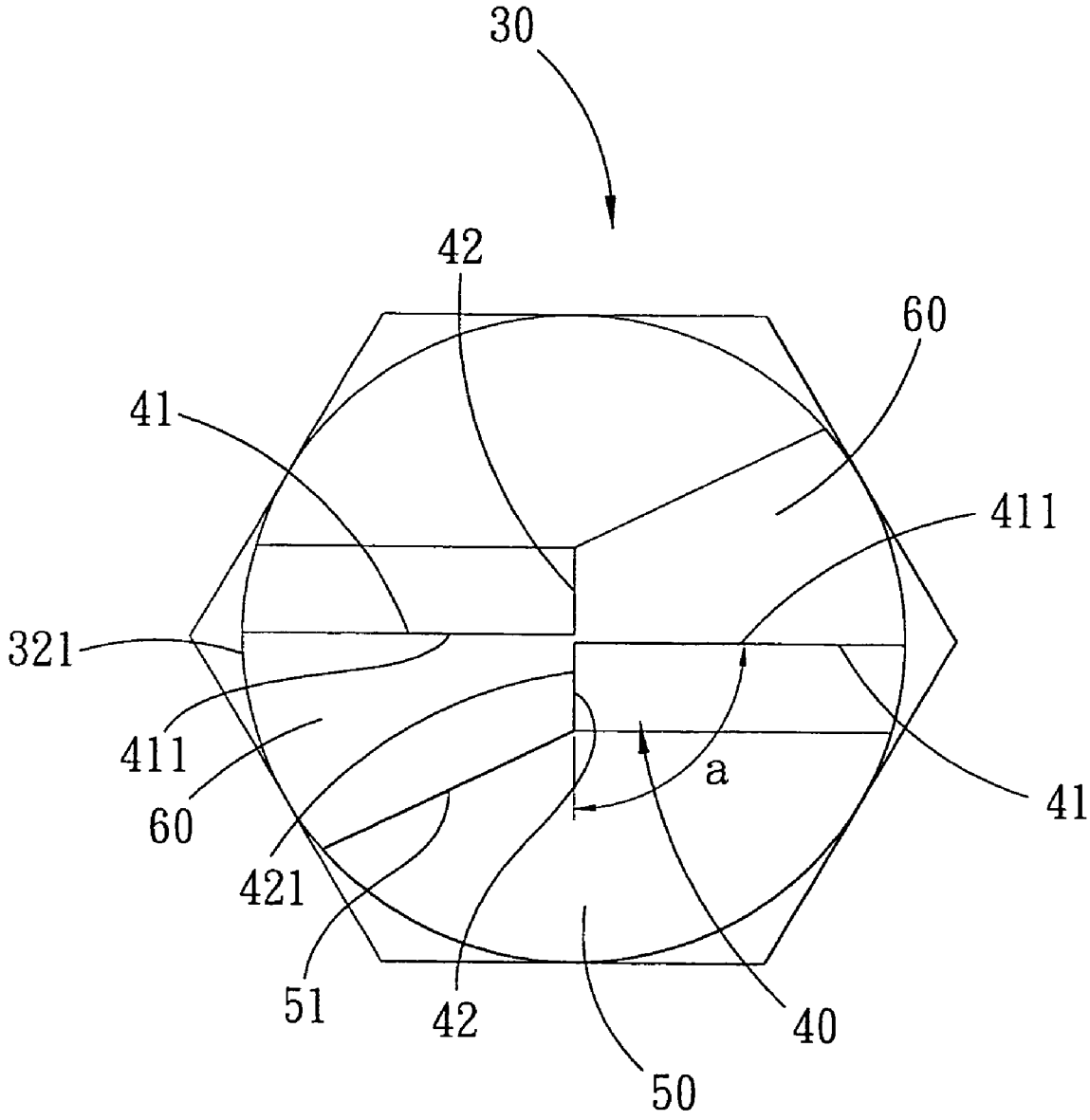
FIG. 7 is a top view of a bit in accordance with the present invention.

Referring to FIGS. 4–7, a bit 30 in accordance with the present invention is shown and generally comprises an axis 31 and tip 32. The tip 32 of the bit 30 comprises two longitudinal recesses 40 formed on the outer periphery 321 and bounded by on one side a scraping surface 41 facing in the counter-clockwise direction and a boundary surface 42 facing in the clockwise direction. An angle between the boundary surface and the scraping surface 41 is 90 degree (as shown in FIG. 7). The scraping surface 41 has a scraping edge 411 extending from the periphery 321 of the bit 30 to the axis 31. The scraping edge 411 is made at an angle in a range of 35 to 80 degree, as shown in FIG. 5, to the axis 31 of the bit 30. The boundary surface 42 has a boundary edge 421 which is a straight line from the boundary surface 42 to the axis 31. The respective boundary edges 421 and the respective scraping edges 411 form a cross, as shown in FIG. 7. Two longitudinal separating surfaces 50 are formed at on the periphery of the tip 32 of the bit 30 and meet the boundary surface 42 at a certain angle. The separating surfaces 50 each has a separating edge 51, so that the separating edges 51, the boundary edges 421, the scraping edges 411 and the periphery 321 of the bit define a relief surface 60 which is generally rectangular-shaped. The angle of the separating edges 51 and the boundary edge 421 to the axis 31 of the bit 30 is less than the angle of the scraping edge 411 to the axis 31 of the bit 30.

Figure 8:
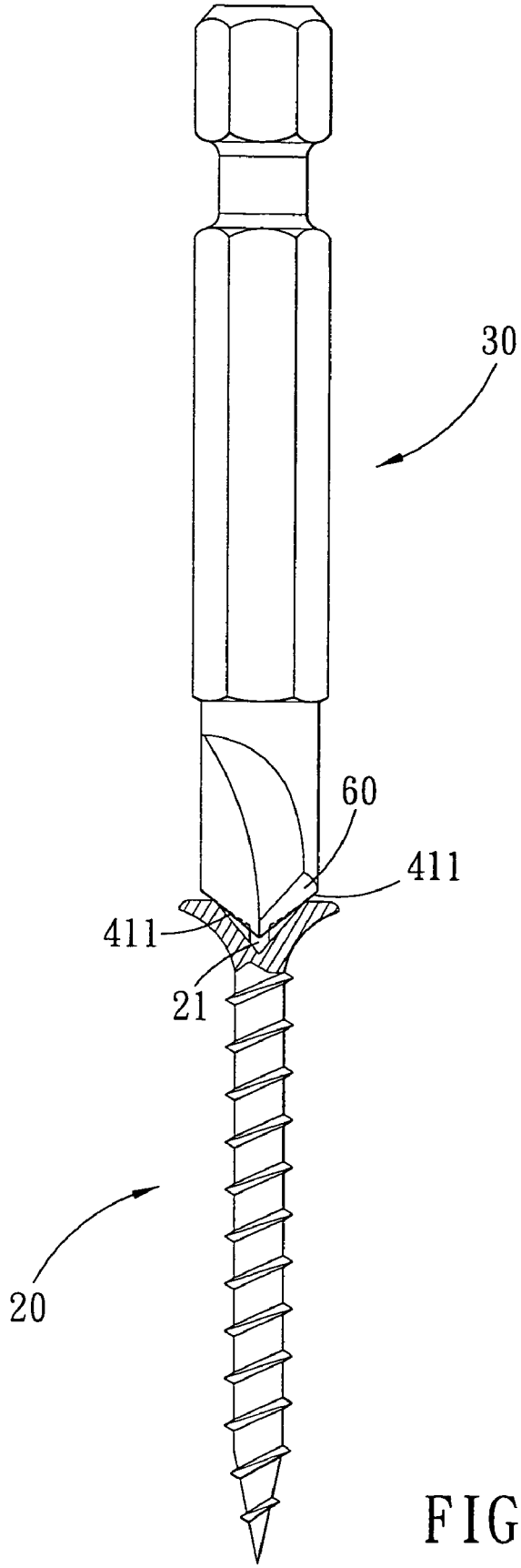
FIG. 8 is an operational view of a bit in accordance with the present invention.

Referring to FIGS. 7 and 8, during the course of removing the damaged screw 20, each of the relief surfaces 60 defined by the separating surface 51, the boundary edge 421, the scraping edge 411 and the periphery 321 of the bit 30 is briefly rectangular formed, so that the two relief surfaces 60 are arranged in a straight line. Thereby, for a same sized bit 30, the relief surface 60 of the present invention is smaller than the corresponding surface of the conventional bit. As a result, the scraping edge 411 of the bit 30 is able to engage the slot 21 of the damaged screw 20 more deeply, so as to get a good purchase and leverage on the damaged screw 20 to remove it easily.

On the other hand, as shown in FIG. 5, the angle of the scraping edge 411 to the axis 31 of the bit 30 is in a range of 35 to 80 degree, and the angle of the separating edges 51 and the boundary edge 421 to the axis 31 of the bit 30 is less than the angle of the scraping edge 411 to the axis 31 of the bit 30. Thereby, the smaller the angle of the scraping edge 411 to the axis 31 of the bit 30 is (but not smaller than 35 degree), the angle of the separating edges 51 and the boundary edge 421 to the axis 31 of the bit 30 will be, and the angle between the two scraping edges 411 will be reduced. In other words, the sharper the tip 32 of the bit 30 is, the easier the tip 32 is able to reach and engage the deepest bottom of the slot 21 of the damaged screw 20, so that the easier the damaged screw 20 is to be removed.

In addition, the angle of the boundary surface 42 of the bit 30 to the scraping surface 41 is 90 degree, and the respective boundary edges 421 and the respective scraping edges 411 form a cross on the tip of the bit. In this case, when the superficial portion of the slot 21 is damaged and the deep portion of the slot 21 is still undamaged, for example, the slot is a cross slot, the bit 30 will be more easier to engage the deep portion of the slot 21 of the damaged screw 20. And the tip 32 is roughly cross-shaped, so that it is more easier for the tip 32 to firmly engage the damaged slot 21 to take it out.

Figure 9:
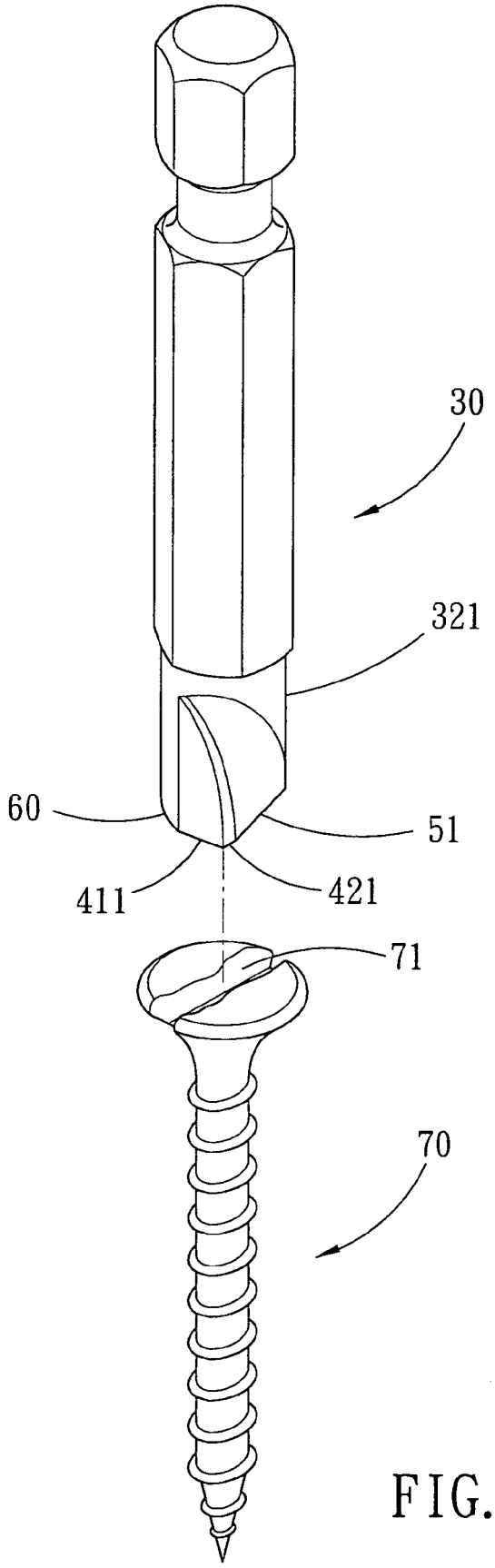
FIG. 9 is another operational view of a bit in accordance with the present invention.

It will be noted that, as shown in FIGS. 7 and 9, the relief surfaces 60 defined by the separating surface 51, the boundary edge 421, the scraping edge 411 and the periphery 321 of the bit 30 is briefly rectangular formed, and the two relief surfaces 60 are arranged in a straight line. Therefore, the bit 30 in accordance with present invention is also adapted to remove the screw 70 with a straight slot 71, thus improving the applicability of the bit 30 of the present invention.

While we have shown and described various embodiments in accordance with the present invention, it should be clear to those skilled in the art that further embodiments may be made without departing from the scope of the present invention.

What is claimed is:

1. A bit for removing damaged screws comprising:

two longitudinal recesses formed on an outer periphery of the bit and bounded by a scraping surface facing in the counter-clockwise direction and a boundary surface facing in the clockwise direction, an angle of the boundary surface to the scraping surface being 90 degree, the scraping surface having a scraping edge, the scraping edge being made at an angle in a range of 35 to 80 degree to an axis of the bit, the boundary surface having a boundary edge, the respective boundary edges and the respective scraping edges being arranged to form a cross, two longitudinal separating surfaces formed at on the outer periphery of the tip of the bit and meet the boundary surface at an angle, the separating surfaces each having a separating edge, the separating edges, the boundary edges, the scraping edges and the periphery of the bit define a relief surface being generally rectangular-shaped, an angle of the separating edges and an angle of the boundary edge to the axis of the bit being less than an angle of the scraping edge to the axis of the bit.

2. The bit for removing damaged screws as claimed in claim 1, wherein the scrape edge is a straight line extending from the periphery of the bit to the axis.

3. The bit for removing damaged screws as claimed in claim 1, wherein the boundary edge is a straight line from the boundary surface to the axis.

* * * * *